US005367133A

United States Patent [19]

Schmidt et al.

[11] Patent Number: 5,367,133

[45] Date of Patent: Nov. 22, 1994

[54] KEYPAD INCLUDING MEMBRANE WITH REPLACEABLE KEY ELEMENTS

[75] Inventors: Hans-Jurgen Schmidt, Hunstetten; Klaus Lindner; Theo L. Eversloh, both of Hohenstein, all of Germany

[73] Assignee: Motorola, Inc., Schaumburg, Ill.

[21] Appl. No.: 51,429

[22] Filed: Apr. 23, 1993

[51] Int. Cl.[5] ..... H01H 13/70

[52] U.S. Cl. ..... 200/5 A; 200/302.1; 200/309; 200/314; 200/345

[58] Field of Search ..... 200/5 A, 512–517, 200/314, 317, 341–345, 302.1–302.3, 308, 309

[56] References Cited

U.S. PATENT DOCUMENTS

| | | | |
|---|---|---|---|
| 4,421,966 | 12/1983 | Pounds | 200/309 |
| 4,489,227 | 12/1984 | Lamarche | 200/314 |
| 4,518,833 | 5/1985 | Watkins | 200/5 A |
| 4,536,625 | 8/1985 | Bebie | 200/5 A |
| 4,571,466 | 2/1986 | Iida | 200/5 A |
| 4,636,593 | 1/1987 | Novak et al. | 200/5 A |
| 4,710,597 | 12/1987 | Loheac | 200/5 A |
| 4,764,770 | 8/1988 | Church | 200/5 A X |
| 5,081,329 | 1/1992 | Mitusinski et al. | 200/314 |

FOREIGN PATENT DOCUMENTS

| | | | |
|---|---|---|---|
| 2539247 | 1/1983 | France . | |
| 3441614 | 7/1985 | Germany . | |
| 9015699 | 4/1991 | Germany . | |
| 01-93015 | 4/1989 | Japan . | |
| 2062304 | 5/1981 | United Kingdom | G04B 47/00 |
| 2151405 | 11/1984 | United Kingdom | H01H 13/70 |
| 2152287 | 7/1985 | United Kingdom | H01H 13/52 |
| 2165696 | 4/1986 | United Kingdom | H01H 13/70 |
| 2178235 | 2/1987 | United Kingdom | H01H 13/70 |
| 2201038 | 8/1988 | United Kingdom . | |

*Primary Examiner*—J. R. Scott

*Attorney, Agent, or Firm*—Donald B. Southard; Charles W. Bethard

[57] ABSTRACT

A keypad (10) comprises a membrane having a plurality of switch actuating portions (41). The keypad (10) further comprises key portions (44) corresponding to said switch actuating portions (41) and located on an opposite side of the membrane to said switch actuating portions (41) and a plurality of switch elements (18) located beneath said switch actuating portions (41) of the membrane. The membrane extends across the keypad (10) and provides a water resistant barrier between the switch elements (18) and the key portions (44) of the membrane. Removable buttons (40) are provided for the keypad (10) and are attached to the key portions (44) of the membrane, whereby pressing of the buttons (40) causes flexing of the membrane and actuation of the switch elements (18) by the switch actuating portion of the membrane.

15 Claims, 2 Drawing Sheets

-PRIOR ART-

KEYPAD INCLUDING MEMBRANE WITH REPLACEABLE KEY ELEMENTS

BACKGROUND TO THE INVENTION

This invention relates, in general, to keypads and is particularly, but not exclusively, applicable to keypads which are sealed in order to prevent moisture and/or dust accumulating therebeneath.

SUMMARY OF THE PRIOR ART

A keypad, such as a hexadecimal keypad, allows a user to either enter information into, or select functions from, equipment. In the case of electrical equipment, such as a cellular radio telephone, which is likely to be subjected to a hostile operational environment caused by the presence of dust or moisture, the keypad is sealed so as to protect any electrical components contained therebeneath.

FIG. 1 illustrates a typical sealed keypad 10. A plurality of keys 12, manufactured from an elastomeric material, form a structure of the keypad 10. Each key 12 comprises a block of material 14 and a contact limb 16 extending downward from the back thereof forming a first switch element. A conductive material 18 is deposited at the tip of the contact limb 16. Each key 12 is attached to each of its adjacent neighbours, forming the structure of the keypad 10, by an angular abutment 20 of elastomeric material attached to the block of material 14 and extending in an outward and downward direction away from the block 14. A lateral connecting strip 22 of material couples the angular abutment 20 of each key 12 to a neighbouring abutment of another key. A housing 24, manufactured from rigid material, encases the structure of the keypad 10. The blocks of material 14, which form the keys 12, protrude above the housing 24. The lateral connecting strip 22 lies on a lightpipe 28 which runs substantially parallel thereto. The lightpipe 28 provide backlighting for the keypad 10 and lies on top of a printed circuit board 30. The printed circuit board 30, more specifically conductive traces 32 included therewith, acts as a second switch element. A plurality of cavities are provided within the lightpipe 28 so as to allow access of the conductive tip 18, of the contact limb 16, to the printed circuit board 30.

In an equilibrium position for the keypad, the conductive tip 18 of the contact limb 16 rests marginally above the printed circuit board. The elastomeric nature of the material and the relationship between the angular abutments 20, the lateral connecting strip 22 and the lightpipe (which form a spring) ensure that upon depression of a key 12 an electrical circuit, comprising the first and second switch elements or specifically the conductive tip 18 and the conductive traces 32 of the printed circuit board 30, is completed. Upon release of the key 12, the spring restores the key to its equilibrium position.

Such a keypad configuration forms an effective form of protection against hostile environment. However, modern electrical equipment often comprises multiple alternative operating modes. This multiple function results in a keypad which is confusing in nature. Specifically, each key may be labelled with several different instructions which uniquely relate to particular functions or operating mode.

It can be appreciated that there is a requirement within the art to provide a keypad which maintains an effective seal against hostile environments whilst offering a keypad instruction set for alternative operating modes which is cheap, effective and intelligible.

SUMMARY OF THE INVENTION

This invention addresses at least some of the deficiencies which arise in the prior art described above. In accordance with a preferred embodiment of the present invention there is provided a keypad comprising a membrane having a plurality of switch actuating portions. The keypad further comprises key portions corresponding to said switch actuating portions and located on an opposite side of the membrane to said switch actuating portions and a plurality of switch elements located beneath said switch actuating portions of the membrane. The membrane extends across the keypad and provides a water resistant barrier between the switch elements and the key portions of the membrane. Removable buttons are provided for the keypad and are attached to the key portions of the membrane, whereby pressing of the buttons causes flexing of the membrane and actuation of the switch elements by the switch actuating portion of the membrane. Therefore, removable buttons, having printed information relating to the functionality of a button within a specific operating mode, may be replaced by other buttons having more relevant information, relating to an alternative operating mode, printed thereon. Furthermore, during the replacement procedure, the integrity of a moisture-proof or dust-proof membrane is maintained and therefore prevents damage, such as oxidation and erosion, to circuitry contained beneath the keypad. Moreover, since the removable buttons are replaceable, the quantity of information printed on each button, relating to a plurality of alternative operating modes, may be substantially reduced with the effect that a user is less likely to be confused when operating the keypad in a specific mode.

In a preferred embodiment the removable button is resistively coupled to the substrate. This resistive coupling can be attributed to the means through which coupling is achieved and the material from which the removable button and/or the substrate is manufactured. In yet another embodiment, a lightpipe is located within the keypad and adjacent to said plurality of switch elements and said switch actuating portions. In an alternative embodiment, the form of the resistive coupling aids in light conduction from the lightpipe to the removable buttons of the keypad. In a further embodiment, the materials from which the membrane and removable buttons are manufactured differ in physical properties. In yet another embodiment, a surface of the membrane which contains said key portions is not visible when said removable buttons are attached to said key portions.

A key may be replaced by exerting a force, which is substantially perpendicular to and away from the plain of the keypad, on a removable button thereby overcoming resistive coupling between the button and the substrate. A new removable button is aligned with the substrate and is resistively coupled thereto by exerting a force on the new button which is substantially perpendicular to and into the plain of the keypad. Furthermore, in order to aid in the alignment and location of the of the removable button in the substrate, an alternative embodiment provides a means for initially aligning the button to the substrate.

An exemplary embodiment of the invention will now be described with reference to the accompanying drawings.

DETAILED DESCRIPTION OF THE PREFERRED EMBODIMENT

Figure 1:
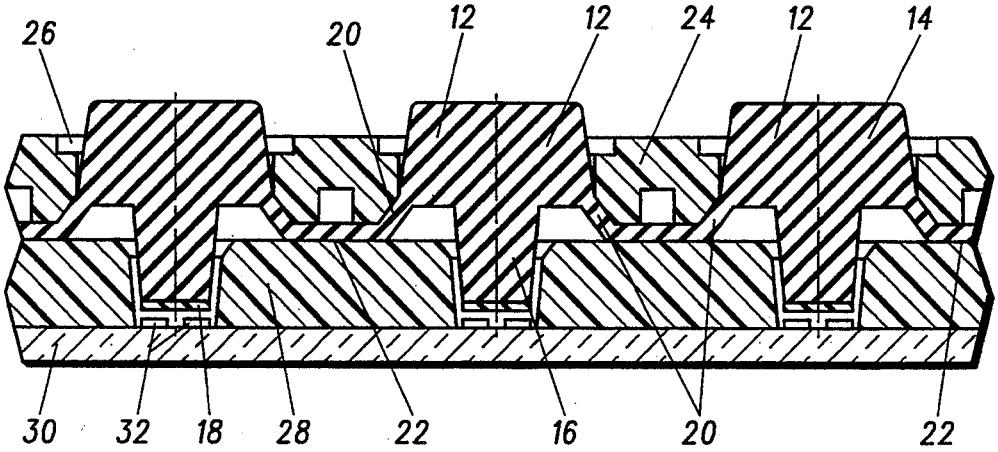
FIG. 1 is a cross-sectional view of a prior art keypad.
Figure 2:
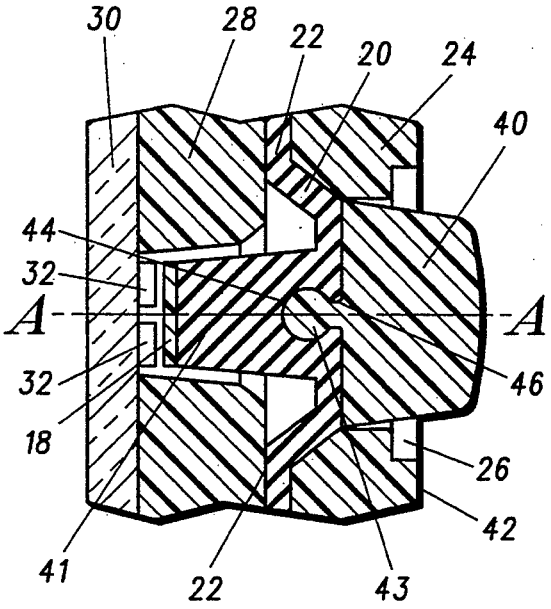
FIG. 2 is a vertical section through a preferred embodiment of a keypad in accordance with the present invention.

FIG. 2 is a vertical section through a preferred embodiment of a keypad in accordance with the present invention. The basic structure of the keypad is identical to that described in the prior art above. However, each key 12 has two distinct sections: a) an upper block 40; and b) a lower contact limb 41 comprising the angular abutments 20, the conductive tip 18 and a segment of the lateral connecting strips 22. In a preferred embodiment, the lower contact limb 41 is manufactured from an elastomeric material whilst the block 40 is manufactured from a durable material such as polyacetal or nylon. It will of course be appreciated that the block 40 may also be manufactured from the elastomeric material. The operational of the keypad is identical to that of the prior art.

The upper block 40 protrudes both above and below an outward facing surface 42 of the housing 24. The upper block 40 is coupled to the lower contact limb 41. Coupling is achieved through the resistive retention of a nodule 43, attached to the upper block 40, within a receptive aperture 44 formed into an upper surface of the lower contact limb 41. The nodule 43 extends to the proximity of the lightpipe 28 and thereby facilitates light conduction from the ligthpipe 28 to the surface of the keypad 10. Furthermore, the diffusion properties of the material from which the blocks and/or nodules are made may be better than the diffusion properties for the elastomer of the lower contact limb 41.

Figure 5:
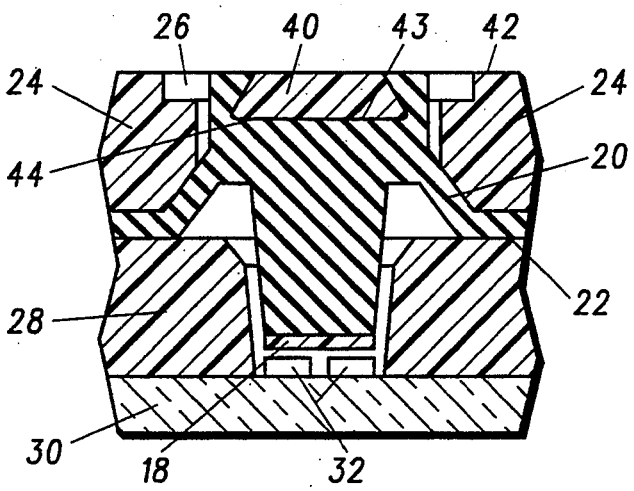
FIG. 5 is a vertical section through an alternative embodiment of a keypad in accordance with the present invention.
Figure 6:
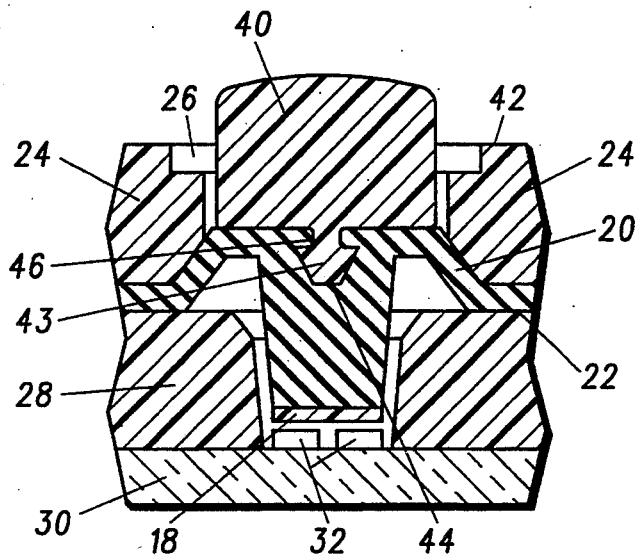
FIG. 6 is a vertical section through an alternative nodule configuration for the keypad of FIG. 2.

In the preferred embodiment, the nodule 43 and receptive aperture are of circular cross-section. Furthermore, the nodule 43 is moulded to the upper block via a stalk 46. It will, of course, be appreciated by one skilled in the art that the nodule may be many shapes or configurations and that the nodule 43 and receptive aperture 44 may have there positions interchanged. An alternative nodule 43 configuration is illustrated in FIG. 6. In this further embodiment, the nodule 43 is wedge-shaped. Alternative embodiments of the present invention would provide other forms of frictional coupling between the upper block 40 and the lower contact limb 41. For example, FIG. 5 illustrates an alternative embodiment for the present invention wherein the block 40 lies flush to the surface of the keypad. In this instance, the block 40 is circumscribed by the lower contact limb 41. Alternatively, the block 40 may be coupled to the lower contact limb in an adhesive manner, such as through the use of valcro TM .

Figure 3:
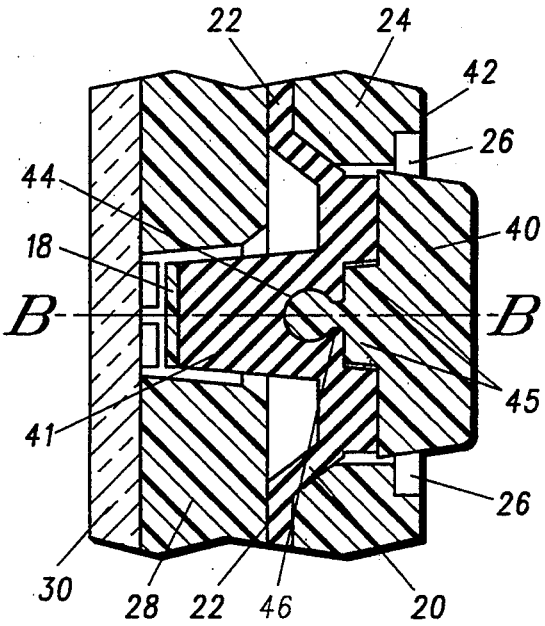
FIG. 3 is a horizontal section through the keypad of FIG. 2.
Figure 4:
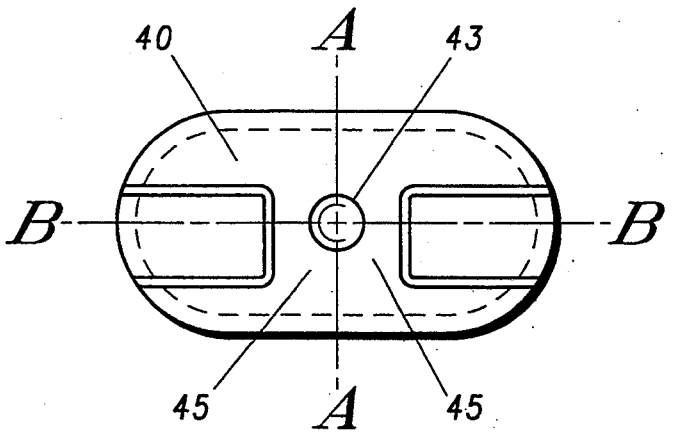
FIG. 4 is a planar rearside view of a preferred embodiment of a button for the keypad of FIG. 2.

The upper block 40 may be extracted from the lower contact limb 41 by applying sufficient upward force to overcome the resistive force that the elastomeric aperture 44 exerts upon the nodule 43 located therein. The upper block 40 is then replaced with a suitably labelled alternative block. To aid in the location of the nodule 43 into the receptive aperture 44, a rectangular shoulder 45 extends about the stalk 46 of the nodule 43 (as illustrated in FIGS. 3 & 4). The shoulders 45 locate within a correspondingly shaped receptive section cut into the lower contact limb 41. In the preferred embodiment, the rectangular shoulders have a major A—A and a minor B—B axis and therefore prevent incorrect location. Moreover, alternative embodiments provide for the asymmetric positioning of the nodule 43 with respect to the rectangular shoulders 45 or vice versa. Such additional embodiments always ensure the correct orientation of the upper block 40 to the lower contact limb 41. It should be apparent to one skilled in the art that either the nodule 43, the receptive aperture 44 or both should be constructed from an elastomeric material in order that release of the block 40 from the lower contact limb may be accomplished without the application of an excessive force which is likely to cause damage to the keypad 10.

It can be appreciated that an invention so designed and described produces the novel advantage of an inexpensive keypad having inter-changeable keys. Therefore, information for multi-mode operation printed on each replaceable button may be substantially reduced with the effect that a user is less likely to be confused. Furthermore, the integrity of a moisture-proof or dust-proof seal is maintained and therefore prevents damage to circuitry, contained beneath the keypad, caused by the exposure of the circuitry to hostile working environments. Further, in the preferred embodiments where the block 40 protrudes above and below the upper surface 42 of the housing 24, a join between the block 40 and the lower contact limb 41 is not immediately visible. The concealment of this join presents the facade of an integral keypad and consequentially prevents tampering. Furthermore, if the join is obscured from view, there is the additional benefit that any dirt which enters the join is also obscured. Moreover, by locating the join below the surface of the keypad, the join becomes more inaccessible to dirt. In addition, by implementing a keypad in accordance with the present invention, a wide range of materials for the block 40 can be selected. Typically, these materials may be harder and more durable than the elastomeric material of the prior art keypad. Furthermore, the wider selection of block materials may provide selection of either a highly translucent or transparent material without limitation to the properties of the material of the membrane, which may accordingly be less translucent or transparent, with the added advantage of an increased light conduction capability and an associated increase in keypad illumination. Yet another benefit derived from the wider selection of block material may be realised in the aesthetically pleasing texture of the block 40 to a user.

It will be appreciated that the above description has been given by way of example only and that modifications in detail may be made within the scope of the invention.

We claim:

1. A keypad comprising:

a) a membrane having:

i) a plurality of switch actuating portions comprising conductive material deposited on an underside of the membrane;

ii) key portions corresponding to said switch actuating portions and located on an opposite side of the membrane to said switch actuating portions; and iii) a plurality of switch elements located beneath said switch actuating portions of the membrane for selective contact with the switch actuating portions of the membrane;

wherein the membrane extends across the keypad and provides a water resistant barrier between the switch elements and the key portions of the membrane; and b) an independently replaceable button for attachment to a key portion of the membrane;

whereby pressing of the button causes flexing of the membrane and actuation of a switch element by the switch actuating portion of the membrane.

2. A keypad in accordance with claim 1, wherein:

the membrane further comprises first fastening means located adjacent to said replaceable button; and said button further comprises second fastening means for coupling to said first fastening means.

3. A keypad in accordance with claim 1, wherein the membrane comprises a surface in which the key portions are located, and said surface of the membrane is not visible when said replaceable buttons are attached to said key portions.

4. A keypad in accordance with claim 1, wherein:

the membrane further comprises first locating means located adjacent to said replaceable button; and said button further comprises second locating means responsive and complementary to said first locating means.

5. A keypad in accordance with claim 4, wherein said first and second locating means are positioned asymmetrical in relation to said membrane and said button.

6. A keypad in accordance with claim 5, wherein said first and second locating means are:

a) a shoulder; and b) a receptive channel into which said shoulder locates.

7. A keypad in accordance with claim 1, wherein the membrane provides a gas resistant barrier between the switch elements and the key portions of the membrane.

8. A keypad comprising:

a) a membrane, constructed from a material with a relatively low light conducting property, having:

i) a plurality of switch actuating portions comprising conductive material deposited on an underside of the membrane;

ii) key portions corresponding to said switch actuating portions and located on an opposite side of the membrane to said switch actuating portions; and iii) a plurality of switch elements located beneath said switch actuating portions of the membrane for selective contact with the switch actuating portions of the membrane;

wherein the membrane extends across the keypad and provides a water resistant barrier between the switch elements and the key portions of the membrane and pressing of the key portion causes flexing of the membrane and actuation of a switch element by the switch actuating portion of the membrane; and b) an independently replaceable button for attachment to a key portion of the membrane and constructed from a material having a relatively high light conducting property and having a coupling portion thereof extending into the membrane for coupling the button to the membrane; and c) a lightpipe located adjacent to said plurality of switch elements, wherein the lightpipe is located in close proximity to the coupling portion of the replaceable button when the button is attached to said key portion thereby facilitating conduction of light from the lightpipe into the button.

9. A keypad in accordance with claim 8, wherein the membrane comprises a surface in which the key portions are located, and said surface of the membrane is not visible when said replaceable buttons are attached to said key portions.

10. A keypad comprising:

a) a membrane having:

i) a plurality of switch actuating portions comprising conductive material deposited on an underside of the membrane;

ii) key portions corresponding to said switch actuating portions and located on an opposite side of the membrane to said switch actuating portions; and iii) a plurality of switch elements located beneath said switch actuating portions of the membrane for selective contact with the switch actuating portions of the membrane;

wherein the membrane extends across the keypad and provides a water resistant barrier between the switch elements and the key portions of the membrane; and b) an independently replaceable button for attachment to a key portion of the membrane, whereby pressing of the button causes flexing of the membrane and actuation of at least one of said plurality of switch elements by the switch actuating portion of the membrane;

wherein the membrane further comprises a receptive aperture located adjacent to said button and said button further comprises a nodule that is resistively and removably coupled into said receptive aperture.

11. A keypad in accordance with claim 10, further comprising a lightpipe located adjacent to said plurality of switch elements and said switch actuating portions, wherein the nodule, when resistively coupled within the receptive aperture, is located in close proximity to the lightpipe.

12. A keypad in accordance with claim 10, wherein the membrane is manufactured from an elastomer.

13. A keypad in accordance with claim 10, wherein the replaceable button is manufactured from a material having a higher durability than that of the membrane.

14. A keypad in accordance with claim 10, wherein light conduction properties of the material for the replaceable button are superior to those of the material for the membrane.

15. A keypad in accordance with claim 10, wherein light diffusion properties of the material for the replaceable buttons are superior to those of the material for the membrane.

* * * * *